US012330260B2

(12) United States Patent
Alagarsamy et al.

(10) Patent No.: US 12,330,260 B2
(45) **Date of Patent: *Jun. 17, 2025**

(54) POLISHING PAD WITH SECONDARY WINDOW SEAL

(71) Applicant: Applied Materials, Inc., Santa Clara, CA (US)

(72) Inventors: Rajkumar Alagarsamy, Sunnyvale, CA (US); Yongqi Hu, Fremont, CA (US); Simon Yavelberg, Cupertino, CA (US); Periya Gopalan, San Jose, CA (US); Christopher R. Mahon, San Bruno, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/295,250

(22) Filed: Apr. 3, 2023

(65) Prior Publication Data

US 2023/0278158 A1 Sep. 7, 2023

Related U.S. Application Data

(63) Continuation of application No. 16/987,206, filed on Aug. 6, 2020, now Pat. No. 11,618,124, which is a (Continued)

(51) Int. Cl.

| | |
|---|---|
| ***B24B 37/22*** | (2012.01) |
| ***B24B 37/20*** | (2012.01) |
| ***B24B 49/12*** | (2006.01) |

(52) U.S. Cl.

CPC ..... *B24B 37/205* (2013.01); *B24B 37/20* (2013.01); *B24B 37/22* (2013.01); *B24B 49/12* (2013.01)

(58) Field of Classification Search

CPC ..... B24B 37/20; B24B 37/205; B24B 37/22; B24B 49/12

(Continued)

(56) References Cited

U.S. PATENT DOCUMENTS

| | | | |
|---|---|---|---|
| 5,738,574 | A | 4/1998 | Tolles et al. |
| 6,358,130 | B1 | 3/2002 | Freeman et al. |

(Continued)

FOREIGN PATENT DOCUMENTS

| | | |
|---|---|---|
| CN | 1569398 | 1/2005 |
| JP | H10-083977 | 3/1998 |

(Continued)

OTHER PUBLICATIONS

International Search Report and Written Opinion in International Application No. PCT/US2014/026455, mailed Jun. 30, 2014, 10 pages.

(Continued)

*Primary Examiner* — Eileen P Morgan
(74) *Attorney, Agent, or Firm* — Fish & Richardson P.C.

(57) ABSTRACT

A polishing article has a polishing surface and an aperture, the aperture including a first section and a second section. The polishing article includes a projection extending inwardly into the aperture. The polishing article includes a lower portion on a side of the first surface farther from the polishing surface. A window has a first portion positioned in the first section of the aperture and a second portion extending into the second section of the aperture. The window has a second surface substantially parallel to the polishing surface. A first adhesive adheres the first surface of the projection to the second surface of the window to secure the window to the projection and a second adhesive of different material composition than the first adhesive. The second (Continued)

adhesive is positioned laterally between the second portion of the window and the lower portion of the polishing article.

10 Claims, 5 Drawing Sheets

Related U.S. Application Data continuation of application No. 15/676,882, filed on Aug. 14, 2017, now Pat. No. 10,744,618, which is a continuation of application No. 14/594,661, filed on Jan. 12, 2015, now Pat. No. 9,731,397, which is a continuation of application No. 13/839,899, filed on Mar. 15, 2013, now Pat. No. 8,961,266.

(58) Field of Classification Search
USPC ..... 451/6, 41, 285, 287, 527, 533, 534
See application file for complete search history.

(56) References Cited

U.S. PATENT DOCUMENTS

| | | | | |
|---|---|---|---|---|
| 6,524,164 | B1 | 2/2003 | Tolles | |
| 6,896,585 | B2 | 5/2005 | Tolles | |
| 7,052,368 | B2 * | 5/2006 | Kim | B24B 37/205 451/6 |
| 7,927,183 | B2 | 4/2011 | Fukuda et al. | |
| 7,942,724 | B2 | 5/2011 | Benvegnu et al. | |
| 8,475,228 | B2 | 7/2013 | Benvegnu et al. | |
| 9,156,126 | B2 | 10/2015 | Kimura | |
| 2003/0109197 | A1 | 6/2003 | Tolles | |
| 2003/0129931 | A1 | 7/2003 | Konno et al. | |
| 2003/0181139 | A1 * | 9/2003 | Lehman | B24B 49/04 451/527 |
| 2003/0190867 | A1 * | 10/2003 | Birang | B24B 51/00 451/6 |
| 2003/0236055 | A1 * | 12/2003 | Swedek | B24B 49/105 451/8 |
| 2004/0082287 | A1 * | 4/2004 | Wright | B24B 37/22 451/490 |
| 2004/0224611 | A1 * | 11/2004 | Aoi | B24B 37/205 451/6 |
| 2009/0253353 | A1 | 10/2009 | Ogawa et al. | |
| 2010/0107971 | A1 | 5/2010 | Cosby et al. | |
| 2010/0227533 | A1 * | 9/2010 | Kulp | B24B 37/205 451/526 |
| 2010/0330879 | A1 | 12/2010 | Paik et al. | |
| 2011/0212673 | A1 | 9/2011 | Benvegnu et al. | |
| 2011/0256818 | A1 * | 10/2011 | Swedek | B24B 37/205 51/297 |
| 2011/0281510 | A1 | 11/2011 | Swedek et al. | |
| 2014/0273762 | A1 * | 9/2014 | Alagarsamy | B24B 49/12 451/527 |
| 2017/0120417 | A1 * | 5/2017 | Lefevre | B24B 37/24 |
| 2017/0246722 | A1 * | 8/2017 | Hu | B24B 37/205 |
| 2019/0061096 | A1 * | 2/2019 | Wang | B24B 37/205 |
| 2019/0111542 | A1 * | 4/2019 | Yun | B24B 37/205 |

FOREIGN PATENT DOCUMENTS

| | | | |
|---|---|---|---|
| JP | 2004-106174 | 4/2004 | |
| JP | 2004-343090 | 12/2004 | |
| JP | 2006-190826 | 7/2006 | |
| JP | 2007-260827 | 10/2007 | |
| JP | 2007-307639 | 11/2007 | |
| JP | 2009-045694 | 3/2009 | |
| JP | 2009-542451 | 12/2009 | |
| JP | 2013-526420 | 6/2013 | |
| JP | 2016-190826 | 11/2016 | |
| TW | 200510470 | 3/2005 | |
| TW | 200628262 | 8/2006 | |
| WO | WO 2004/014603 | 2/2004 | |
| WO | WO-2004014603 A2 * | 2/2004 | B24B 37/013 |
| WO | WO 2008/047631 | 4/2008 | |

OTHER PUBLICATIONS

Notice of Allowance in Korean Appln. No. 10-2015-7029500 dated Apr. 21, 2020, 3 pages (with English Translation).
Office Action in Chinese Appln. No. 201480015298.1, dated Aug. 2, 2016, 7 pages (English Search Report).
Office Action in Japanese Appln. No. 2016-502148, dated May 15, 2017, 8 pages (with English translation).
Office Action in Taiwan Appln. No. 103109723, dated Oct. 15, 2015, 10 pages (English Search Report).

* cited by examiner

POLISHING PAD WITH SECONDARY WINDOW SEAL

CROSS-REFERENCE TO RELATED APPLICATIONS

This application is a continuation of and claims priority to U.S. application Ser. No. 16/987,206, filed Aug. 6, 2020, which is a continuation of and claims priority to U.S. application Ser. No. 15/676,882, filed Aug. 14, 2017, which is a continuation of and claims priority to U.S. application Ser. No. 14/594,661, filed on Jan. 12, 2015, which is a continuation of and claims priority to U.S. application Ser. No. 13/839,899, filed on Mar. 15, 2013, the entire disclosures of which are incorporated by reference.

TECHNICAL FIELD

The invention generally relates to polishing pads with a window, systems containing such polishing pads, and processes for making and using such polishing pads.

BACKGROUND

In the process of fabricating modern semiconductor integrated circuits (IC), it is often necessary planarize the outer surface of the substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a polishing pad for a chemical mechanical polishing apparatus includes a polishing article having a polishing surface and an aperture formed through the polishing article. The aperture includes a first section adjacent the polishing surface and a second section adjacent the first section. The polishing article includes a projection extending inwardly into the aperture such that the first section has a different lateral dimension from the second section. The projection has a first surface substantially parallel to the polishing surface. The polishing article includes a lower portion on a side of the first surface farther from the polishing surface. The polishing article includes a window has a first portion positioned in the first section of the aperture and a second portion extending into the second section of the aperture, the window having a second surface substantially parallel to the polishing surface. The a polishing article includes a first adhesive adhering the first surface of the projection to the second surface of the window to secure the window to the projection and a second adhesive of different material composition than the first adhesive, the second adhesive positioned laterally between the second portion of the window and the lower portion of the polishing article.

Implementations may include one or more of the following features. The first section of the aperture may be wider than the second section of the aperture, and the projection is laterally adjacent the second section of the aperture. The first surface may be an upper surface of the projection and the second surface may be a lower surface of the window. The first section of the aperture may be narrower than the second section of the aperture, and the projection is laterally adjacent the first section of the aperture. The first surface may be a lower surface of the projection and the second surface may be an upper surface of the window. The polishing article may include a polishing layer having the polishing surface and a backing layer, the backing layer providing the lower portion. The backing layer may be softer than the polishing layer. The second adhesive may have greater adhesion to the window than the first adhesive. The first adhesive may include a pressure-sensitive adhesive. The first adhesive may include a double-sided adhesive tape. The second adhesive may be a UV-curable adhesive. The second adhesive may be positioned laterally between the first adhesive and the second section of the window. The polishing pad may include a recess formed in the second section of the window. A top surface of the window may be substantially coplanar with the polishing surface.

In another aspect, a method of forming a window in a polishing pad includes forming an aperture in a polishing article such that the polishing article includes a projection extending inwardly into the aperture and a first section of the aperture has a different lateral dimension from a second section of the aperture. The projection has a first surface substantially parallel to a polishing surface of the polishing article. The polishing article includes a lower portion on a side of the first surface farther from the polishing surface. A window is secured in the aperture with a first adhesive that adheres the first surface of the polishing article to a second surface of the window. A liquid precursor is dispensed into a gap between the window and the lower portion of the polishing article and curing the liquid precursor to form a second adhesive of different composition than the first adhesive.

Implementations can include one or more of the following features. The first surface may be an upper surface of the projection and the second surface may be a lower surface of the window. The first surface may be a lower surface of the projection and the second surface may be an upper surface of the window. Curing the liquid precursor may include applying ultraviolet (UV) light. Securing the window may include applying a pressure sensitive adhesive to at least one of the upper surface and the bottom surface and pressing the upper surface against the bottom surface. Applying the pressure sensitive adhesive may include applying a double-sided adhesive tape. Forming the aperture may include at least one of cutting or molding the polishing article. Forming the aperture may include forming a first section of the aperture in a polishing layer and forming a second section of the aperture in a backing layer. Curing the liquid precursor may form the second adhesive with greater adhesion to the window than the first adhesive.

Implementations may provide one or more of the following advantages. A second adhesive used in addition to a first adhesive can provide better adhesion between a window and a polishing pad. The second adhesive can degrade more slowly than the first adhesive and can be more heat resistant, providing a longer window lifetime. The second adhesive may form a secondary window seal between the window and the polishing pad and prevent leaking of polishing liquids into a region underneath the window in which sensitive optical measurement equipment is located.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
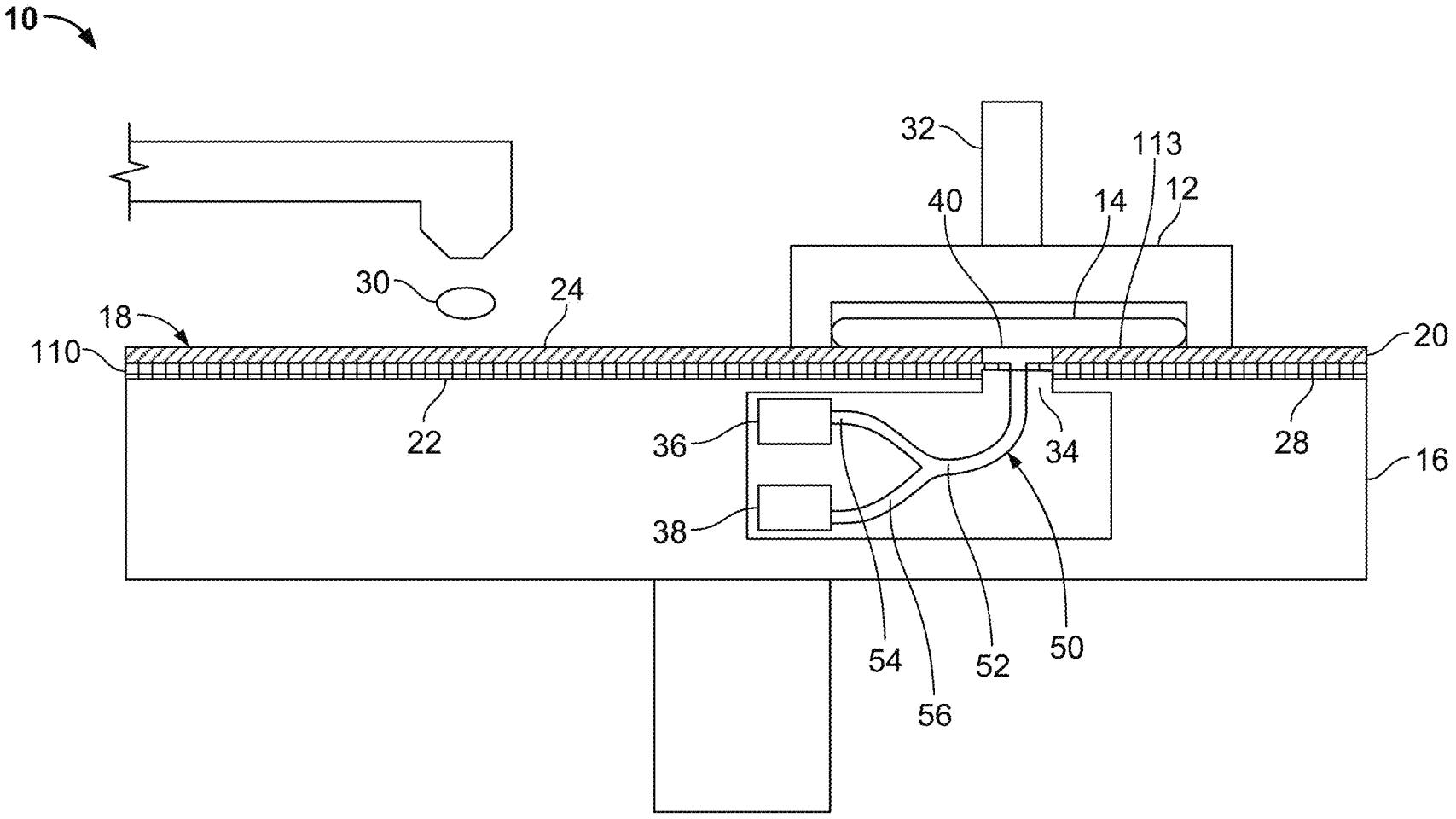
FIG. 1 is a cross-sectional view of a CMP apparatus containing a polishing pad.

As shown in FIG. 1, the CMP apparatus 10 includes a polishing head 12 for holding a semiconductor substrate 14 against a polishing pad 18 on a platen 16. The CMP apparatus may be constructed as described in U.S. Pat. No. 5,738,574, the entire disclosure of which is incorporated herein by reference.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The effective portion of the polishing pad 18 can include a polishing layer 20 with a polishing surface 24 to contact the substrate and a bottom surface 22 in contact with a top surface 112 of a backing layer 110, the backing layer 110 having a bottom surface that is secured to the platen 16 by an adhesive layer 28, e.g., an adhesive tape. An adhesive layer 113 is also provided between the bottom surface 22 of the polishing layer and the top surface 112 of the backing layer 110. The polishing layer 20 can include, e.g., a foamed polyurethane, with at least some open pores on the polishing surface 24. In some embodiments, backing layer 110 is softer than the polishing layer 20. For example, the backing layer 110 can be formed of a relatively compressible layer, such as a Suba-IV layer (from Rodel, Phoenix Ariz.). The adhesive layer 28 can be a double-sided adhesive tape, e.g., a thin layer of polyethylene terephthalate (PET), e.g., Mylar™, with adhesive, e.g., pressure-sensitive adhesive, on both sides.

The polishing pad 18 has a window of solid material 40 (shown in FIG. 2A) disposed in an aperture 45 that is formed through the polishing pad 18 and is held in place by an adhesive layer 130.

An optical aperture 34 is formed in the top surface of the platen 16. An optical monitoring system, including a light source 36, such as a laser or white light source, and a detector 38, such as a photodetector or spectrometer, can be located below the top surface of the platen 16. For example, the optical monitoring system can be located in a chamber inside the platen 16 that is in optical communication with the optical aperture 34, and can rotate with the platen. One or more optical fibers 50 can carry light from the light source 36 to the substrate 14, and from the substrate 14 to the detector 38. For example, the optical fiber 50 can be a bifurcated optical fiber, with a trunk 52 in proximity, e.g., abutting, a window 40 in the polishing pad, a first leg 54 connected to the light source 36, and a second leg 56 connected to the detector 38.

The optical aperture 34 can be filled with a transparent solid piece, such as a quartz block (in which case the fiber would not abut the window 40 but could abut the solid piece in the optical aperture), or it can be an empty hole. In one implementation, the optical monitoring system and optical aperture are formed as part of a module that fits into a corresponding recess in the platen. Alternatively, the optical monitoring system could be a stationary system located below the platen, and the optical aperture could extend through the platen. The light source 36 can employ a wavelength anywhere from the far infrared to ultraviolet, such as red light, although a broadband spectrum, e.g., white light, can also be used, and the detector 38 can be a spectrometer. The information collected by detector 38 is processed to determine whether the polishing endpoint has been reached. For example, a computer (not illustrated) can receive the measured light intensity from detector 38 and use it to determine the polishing endpoint (e.g., by detecting a sudden change in the reflectivity of substrate 14 that indicates the exposure of a new layer, by calculating the thickness removed from the outer layer (such as a transparent oxide layer) of substrate 14 using interferometric principles, and/or by monitoring the signal for predetermined endpoint criteria).

Typically the polishing pad material is wetted with the chemical polishing liquid 30, which can include abrasive particles. For example, the slurry can include KOH (potassium hydroxide) and fumed-silica particles. However, some polishing processes are "abrasive-free".

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. The pressure and relative motion between the substrate and the polishing surface, in conjunction with the polishing solution, result in polishing of the substrate.

The polishing head 12 and the substrate 14 can translate during operation of apparatus 10. In general, light source 36 and light detector 38 are positioned such that they have a view of substrate 14 during a portion of the rotation of platen 16, regardless of the translational position of head 12. As a further example, the optical monitoring system can be a stationary system located below platen 16.

Figures 2A, 2B, 2C:
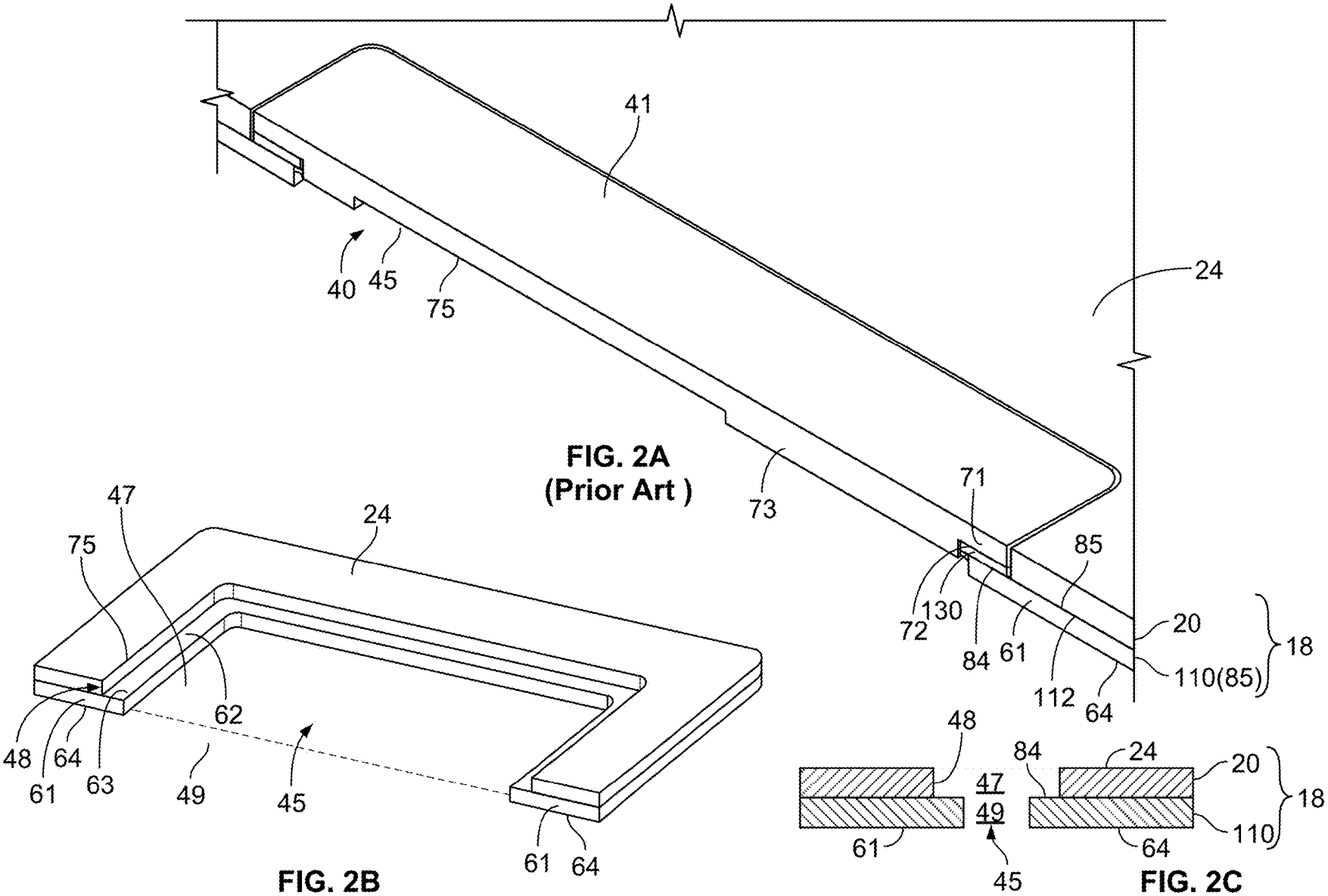
FIG. 2A (Prior Art)
FIG. 2A is a perspective top view of a cross-section of a polishing pad with a window.
FIG. 2B is a perspective top view of a cross-section of a polishing pad before a window is placed.
FIG. 2C is a cross-sectional side view of polishing pad before a window is secured.

FIGS. 2A-2C show a window 40 that is adhered to a projection 61 in a backing layer 110 of the polishing pad 18. The aperture 45 into which the window 40 is positioned may be formed by cutting through the polishing pad or the aperture 45 may be molded into the polishing pad. The aperture 45 includes a first section 47 (shown in FIG. 2B) and a second section 49 that is narrower in cross-sectional dimension than the first section 47. The first section 47 is adjacent the polishing surface 24 and a second section 49 of the aperture 45 is adjacent the first section 45. The second section 49 can extend to the bottom surface 64 of the polishing pad 18. In some implementations, the first section 47 of the aperture corresponds to a hole through the polishing layer 20 and the second section 49 corresponds to a hole through the backing layer 110. In this case the depth of the first section 47 of the aperture is defined by the thickness of the polishing layer 20 and the depth of the second section 49 of the aperture is defined by the thickness of the backing layer 110.

A projection 61 of the polishing pad, e.g., of the backing layer 110, extends inwardly into the aperture 45 such that the first section 47 has a different lateral dimension from the second section 49. In other words, projection 61 extends past an edge 48 of the first section 47 of the aperture 45 to provide a ledge 62 having an upper surface 63. The upper surface 63 can be parallel but recessed relative to the polishing surface 18. The projection 61 has a first surface 84 that is substantially parallel to the polishing surface 24. The polishing pad 18 has a lower portion 85 on a side of the first surface 84 that is farther from the polishing surface 24. For example, a portion of the backing layer 110 can form the lower portion 85.

Although FIGS. 2A-2C illustrate a polishing pad with a polishing layer and a backing layer, in some implementations the polishing pad could have only a polishing layer. In this case, both the first section and the second section of the aperture would be formed in the polishing layer, and the lower portion would be part of the polishing layer.

The window 40 has a first portion 71 that is positioned in the first section 47 of the aperture 45. The first portion 71 of the window 40 has a bottom surface 72. The window 40 has a second portion 73 that extends into the second section 49 of the aperture 45. A recess 75 is formed in the second portion 73 of the window 40. As a can be seen more clearly in FIG. 4B, the recess 75 need not be centered with the window 40. Atop surface 41 of the window is substantially coplanar with the polishing surface 24.

Typically, a first adhesive 130 is applied on the ledge 62 between the upper surface 63 and the bottom surface 72 of the first portion 71 of the window 40 to secure the window 40 to the ledge 62. In general, the first adhesive 130 is formed of a material that has good adhesion to both the window 40 and the backing layer 110. The first adhesive 130 can be a pressure-sensitive adhesive, for example, a double coated film tape, e.g., a thin layer of polyethylene terephthalate (PET), e.g., Mylar™, with pressure-sensitive adhesive on both sides. Commercially available double coated film tapes are available from, for example, Minnesota Mining and Manufacturing Co., Inc. (St. Paul, Minn.) (e.g., a member of the 442 family of double coated film tapes). Adhesive tapes from which the first adhesive 130 can be formed are also commercially available from, for example, Scapa North America (Windsor, Conn.). The window 40 can be secured by applying a pressure sensitive adhesive to at least one of the upper surface 63 and the bottom surface 72 and pressing the upper surface 63 against the bottom surface 72. Using a pressure sensitive adhesive allows better adhesion conformance of the window to the pad during high down force polishing.

The polishing process produces heat due to frictional forces acting between the polishing pad 18 and the substrate 14. The heat could cause an increase in temperature of both the polishing layer 20 and the backing layer 110. This in turn increases the temperature of the first adhesive 130 which is in contact with the polishing layer 20 and the backing layer 110. The increase in temperature can cause the first adhesive 130 to degrade, increasing the probability that slurry will leak between the window 40 and the polishing pad. Such degradation can impact or interfere with the optical measurements being made (e.g., such as by moisture formation at a region under the window 40, the first adhesive 130, backing layer 110) when liquids associated with the polishing process (e.g., slurry or water) leak from surface 41 of window 40 to a region under the window 40, the first adhesive 130 and the backing layer 110. There is also concern that the lateral frictional force from the substrate 14 during polishing can be greater than the adhesive force of the first adhesive 130 between the window 40 and a lower portion 85 of the polishing pad 18. In addition, the first adhesive 130 may degrade over time and lose its adhesive properties, causing the window 40 to become un-adhered or detached from the polishing pad 18.

Figure 3:
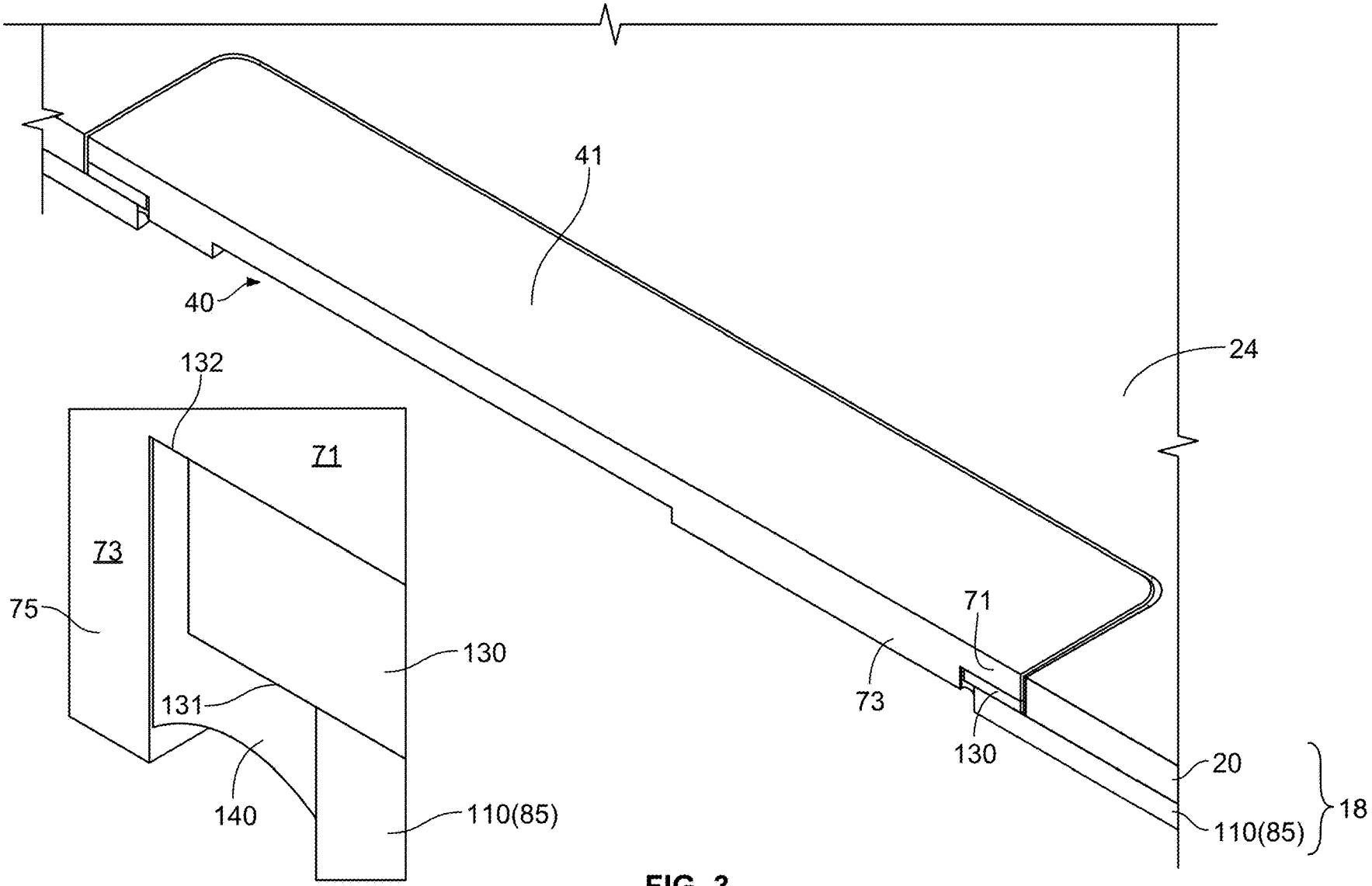
FIG. 3 is a perspective top view of a cross-section of a polishing pad with a window.

To reduce the probability of leakage and/or the possibility of the window becoming un-adhered or detached from the polishing pad, FIG. 3 shows an embodiment in which a second adhesive 140 having a different material composition than the first adhesive is provided laterally between the lower portion 85 of the polishing pad and the second portion 73 of the window 40. The second adhesive 140 can be dispensed in the form of a liquid precursor into the gap between the window 40 and the lower portion 61 of the polishing pad 18. The liquid precursor is then cured to form the second adhesive 140.

As shown in enlarged details, the second adhesive 140 can cover a lower surface 131 of the first adhesive 130 and also fill a gap 132 between the first adhesive 130 and a side wall 75 of the second portion 73 of the window 40. The second adhesive can be positioned laterally between the second portion 73 of the window 40 and the lower portion 85 of the polishing pad 18. The second adhesive 140 can be formed after the window 40 has first been secured by the first adhesive 130 to the polishing pad 18. Examples of a suitable liquid precursor include epoxy-based adhesives, such as Magnobond, or acrylic based adhesives.

Curing the liquid precursor may include applying electromagnetic radiation, for example, ultraviolet light to the liquid precursor. The curing process may take less than a minute, e.g., 10-20 seconds under an off-the-shelf handheld UV curing lamp to yield the second adhesive 140.

The second adhesive 140 can provide better adhesion between the window 40 and the polishing pad 18 than the first adhesive 130. The second adhesive 140 generally does not degrade as quickly as first adhesive 130 and is not as sensitive to thermal degradation as the first adhesive 130. The second adhesive 140 may form a secondary window seal between the window 40 and the polishing pad 18.

Although the top surface of the window 40 is depicted as flushed with the polishing surface 24 of the polishing layer 20, in some embodiments the top surface can be recessed below the polishing surface 24.

Figure 5A:
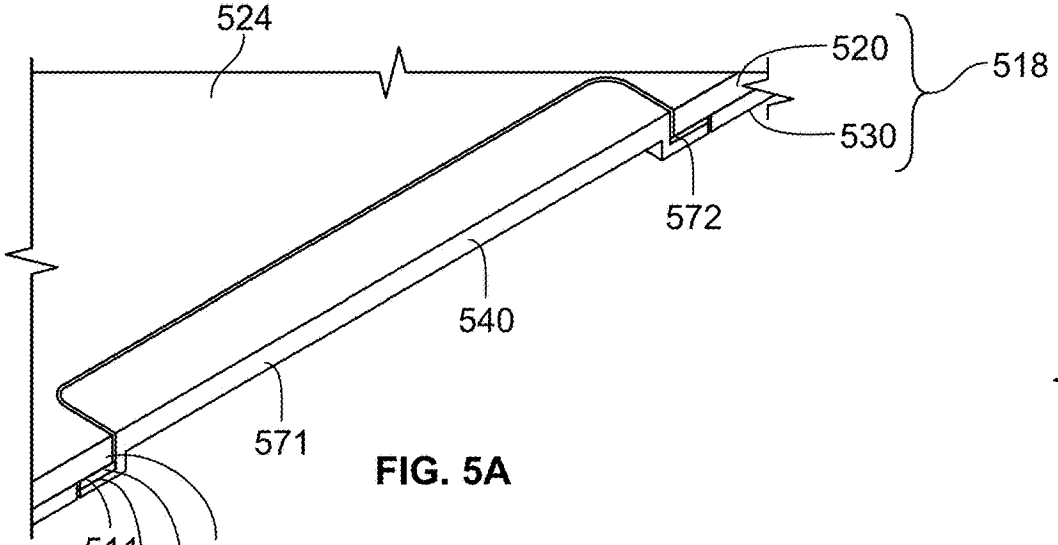
FIG. 5A is a perspective top view of a cross-section of a polishing pad with a window.
Figure 5C:
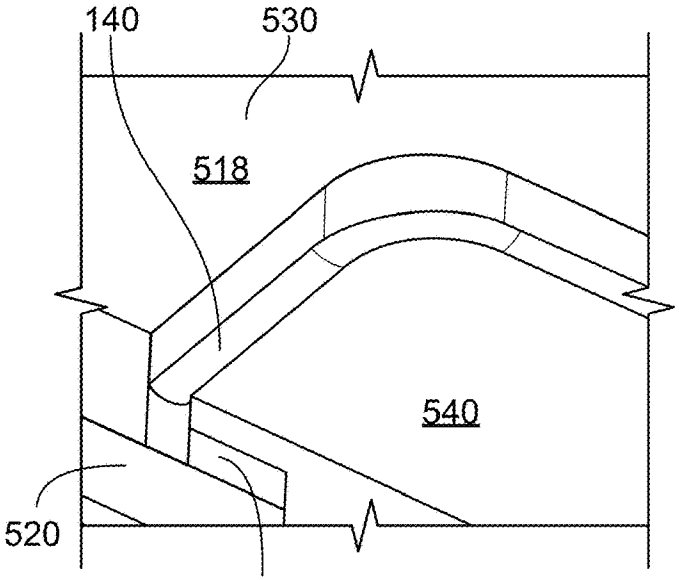
FIG. 5C is a close up bottom prospective view of the polishing pad shown in FIG. 5B.
Figure 5B:
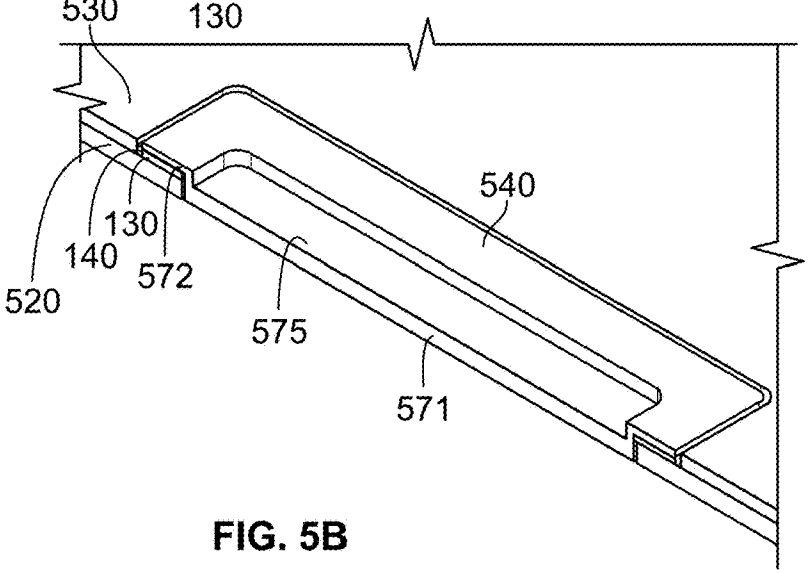
FIG. 5B is a perspective bottom view of a cross-section of the polishing pad shown in FIG. 5A.
Figure 5D:
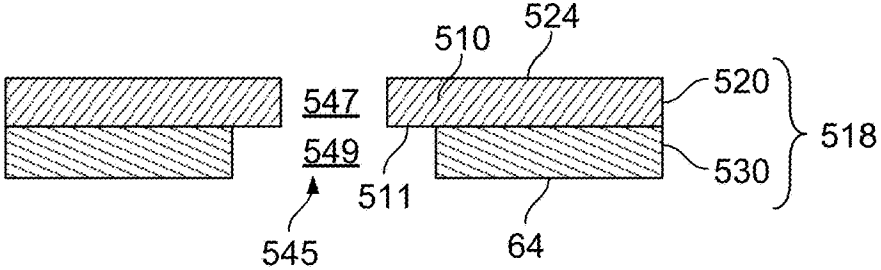
FIG. 5D is a cross-sectional side view of the polishing pad shown in FIG. 5A before a window is secured.

FIGS. 5A-5C show a window 540 that is adhered to a projection 510 in a polishing layer 520 of a polishing pad 518. The polishing pad 518 has a polishing surface 524 and an aperture 545 formed through the polishing pad 518. The aperture 545 includes a first section 547 adjacent the polishing surface 524 and a second section 549 adjacent the first section 547. The polishing pad 518 includes a projection 510 extending inwardly into the aperture 545 such that the first section 547 has a different (i.e., smaller) lateral dimension from the second section 549. The projection 510 has a first surface 511 substantially parallel to the polishing surface 524. The first surface 511 can be a lower surface of the polishing layer 520, i.e., the side of the polishing layer 520 opposite the polishing surface 524. The polishing pad 518 includes a lower portion 530 on a side of the first surface 511 farther from the polishing surface 524. For example, the lower portion 530 may be a backing layer.

The window 540 has a first portion 571 positioned in the first section 547 of the aperture 545 and a second portion 572 extending into the second section 549 of the aperture 545. The window 540 has a second surface 573 substantially parallel to the polishing surface 524. The second portion 572 has a larger lateral dimension than the first portion 571. A recess 575 can be formed in the bottom surface of the window, so that the second portion 572 forms an L-shaped flange projecting outward from the first portion. The second surface 573 can be the top surface of the second portion 572, e.g., the top surface of the flange.

The first adhesive 130 adheres the first surface 511 of the projection to the second surface 573 of the window 540 to secure the window 540 to the projection 510. The second adhesive 140 (shown in detail in FIG. 5C) of different material composition than the first adhesive 130, the second adhesive 140 positioned laterally between the second portion 572 of the window 540 and the lower portion 530 of the polishing pad 518. The second adhesive 140 can directly contact the bottom surface of the polishing layer. The second adhesive 140 can fill a lateral gap between the first adhesive 130 and the lower portion 530 of the polishing pad 518.

Figure 4A:
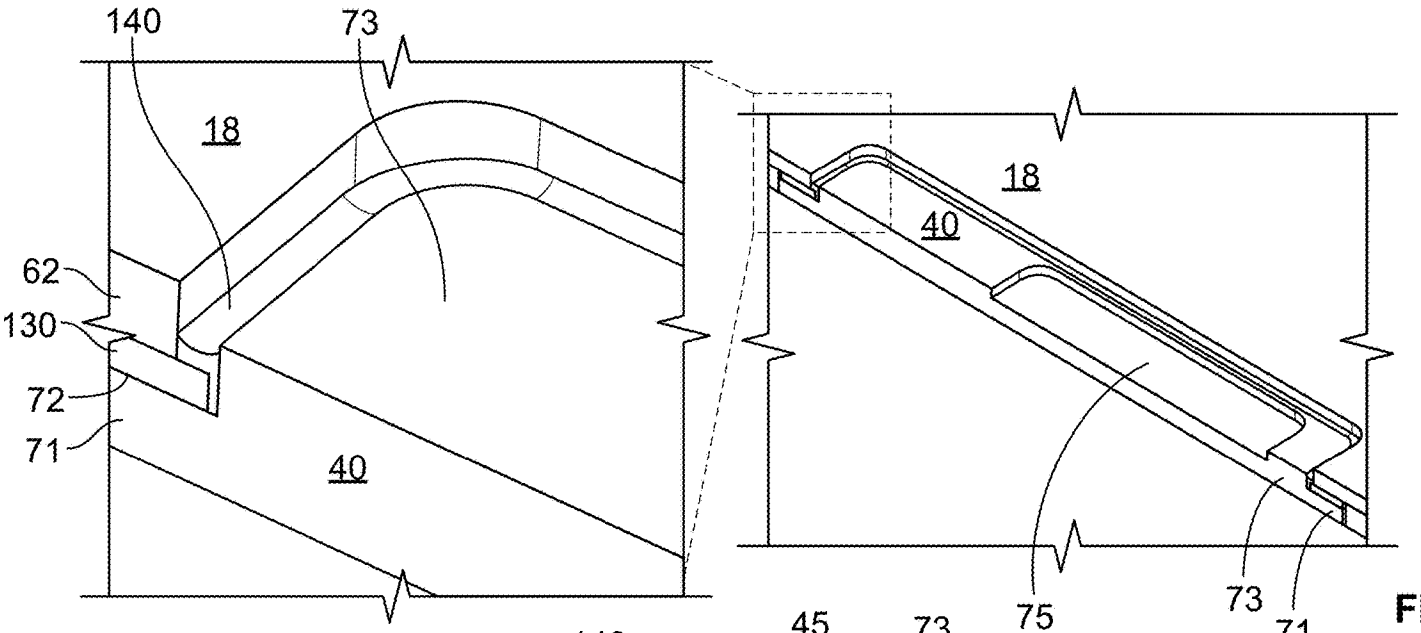
FIG. 4A is a perspective bottom view of a cross-section of the polishing pad shown in FIG. 3.
Figure 4B:
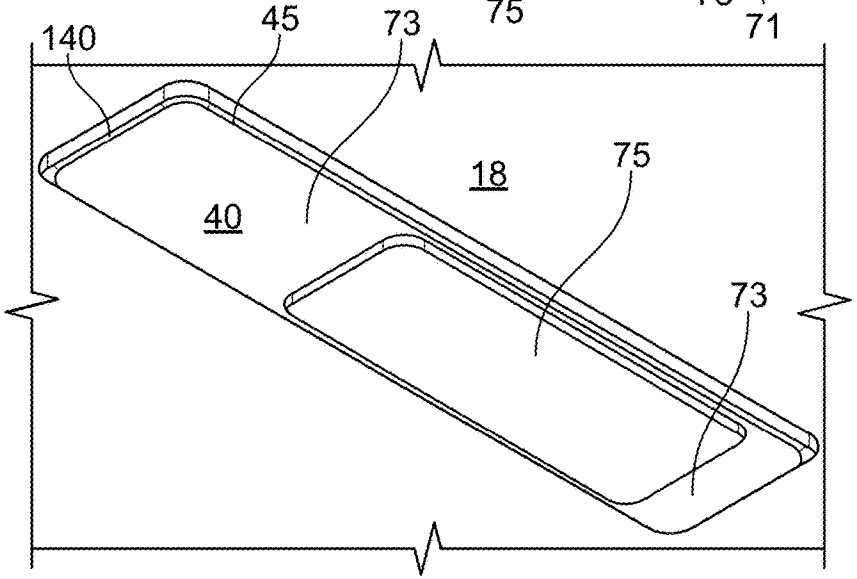
FIG. 4B is a perspective bottom view of the polishing pad shown in FIG. 3.

The polishing pad illustrated in FIGS. 5A-5D can be manufactured in a manner similar to the pad in FIGS. 3-4B, but the window 540 is inserted into the aperture 540 from the underside of the pad 518.

In general, backing layer 110, covering layer 120 and adhesive layer 130 can be formed of any appropriate materials for use in CMP processes. For example, layers 110, 120 and 130 can be formed from materials used in the corresponding layers in commercially available polishing pads, such as an IC-1000 polishing pad or IC-1010 polishing pad (from Rodel, Phoenix, Ariz.). In certain embodiments, the material from which window 40 is made is relatively resistant to the conditions to which it is exposed during the CMP process. As an example, the material from which window 40 is made can be relatively chemically inert to the slurry and substrate material. As another example, the window can be relatively resistant to scratching and/or abrasion caused by the slurry (e.g., containing one or more chemical agents and optionally abrasive particles) used in the CMP process. As a further example, the material from which window 40 is made can be relatively resistant to scratching and/or abrasion caused by the substrate. As another example, the material from which window 40 is made can be relatively resistant to scratching and/or abrasion caused by the pad conditioner. In embodiments, window 40 can be formed of a material having a Shore D hardness of from about 40-95.

In general, window 40 is formed of one or more polymeric materials, such as, for example, a polyurethane or a halogenated polymer (e.g., polychlorotrifluoroethylene (PCTFE), perfluoroalkoxy (PFA), fluorinated ethylene propylene (FEP), or polytetrafluoroethylene (PTFE)). Examples of commercially available polymeric materials from which window 40 can be formed include polyurethane materials available from Rodel (Phoenix, Ariz.), Calthane ND3200 polyurethane (from Cal Polymers, Long Beach, Calif.), Conoptic DM-2070 polyurethane (Cytec Industries Inc., West Paterson, N.J.), FEP X 6301, FEP X 6303, and FEP X 6307 (all from Dyneon LLC, Oakdale, Minn.), the Neoflon® family of PCTFE polymers (from Daikin America, Inc., Orangeburg, N.J.) and the Teflon® family of PTFE polymers (from E.I. du Pont de Nemours and Company, Wilmington, Del.).

Other embodiments are in the claims.

What is claimed is:

1. A polishing pad for a chemical mechanical polishing apparatus, comprising:

a polishing article having an upper layer with a polishing surface, a lower portion, and an aperture formed through the polishing article, the aperture including a first section adjacent the polishing surface and through the upper layer and a second section adjacent the first section and through the lower portion, wherein the lower portion forms a projection extending inwardly into the aperture beyond an edge of the upper layer such that the second section is narrower than the first section, the projection having an upper surface substantially parallel to the polishing surface;

a window having a top surface substantially parallel to and coplanar with the polishing surface, a second portion aligned with the second section of the aperture and having a bottom surface with a recess that is narrower than the second section of the aperture, and a first portion extending outwardly from the second portion over the projection from the polishing article;

a first adhesive adhering an upper surface of the projection to a bottom of the first portion of the window; and a second adhesive of different material composition than the first adhesive, the second adhesive positioned laterally between the second portion of the window and the projection.

2. The polishing pad of claim 1, wherein the second adhesive extends vertically between the first adhesive and the second portion of the window.

3. The polishing pad of claim 1, wherein the polishing article comprises a polishing layer having the polishing surface and a backing layer, the backing layer providing the projection.

4. The polishing pad of claim 3, wherein the first portion is thinner than the polishing layer.

5. The polishing pad of claim 3, wherein the backing layer is softer than the polishing layer.

6. The polishing pad of claim 1, wherein the bottom surface of the window is recessed relative to a bottom surface of the polishing pad.

7. The polishing pad of claim 1, wherein the second adhesive has greater adhesion to the window than the first adhesive.

8. The polishing pad of claim 1, wherein the first adhesive comprises a pressure-sensitive adhesive.

9. The polishing pad of claim 8, wherein the first adhesive comprises a double-sided adhesive tape.

10. The polishing pad of claim 8, wherein the second adhesive comprises a UV-curable adhesive.

* * * * *